US005713174A

United States Patent [19]

Kramer

[11] Patent Number: 5,713,174

[45] Date of Patent: Feb. 3, 1998

[54] CONCRETE SLAB DOWEL SYSTEM AND METHOD FOR MAKING SAME

[76] Inventor: Donald R. Kramer, 3673 Old Lewis River Rd., Woodland, Wash. 98674

[21] Appl. No.: 587,229

[22] Filed: Jan. 16, 1996

[51] Int. Cl.[6] ..... E04F 15/14; E04B 1/682

[52] U.S. Cl. ..... 52/396.02; 52/396.1; 52/318; 404/52; 404/59; 404/62; 404/74

[58] Field of Search ..... 52/318, 396.1, 52/396.02; 404/74, 52, 59, 60, 62, 63

[56] References Cited

U.S. PATENT DOCUMENTS

| | | | |
|---|---|---|---|
| 2,163,397 | 6/1939 | Friberg | 404/63 |
| 2,186,104 | 1/1940 | Geyer et al. | 404/60 |
| 2,305,979 | 12/1942 | Mitchell | 52/396.02 X |
| 5,216,862 | 6/1993 | Shaw et al. | 52/396 |
| 5,470,174 | 11/1995 | Hu et al. | 52/396.02 X |
| 5,487,249 | 1/1996 | Shaw et al. | 52/396.02 X |

FOREIGN PATENT DOCUMENTS

| | | | |
|---|---|---|---|
| 867495 | 5/1961 | United Kingdom | 404/59 |
| 2185046 | 7/1987 | United Kingdom | 404/63 |

*Primary Examiner*—Wynn E. Wood
*Assistant Examiner*—Timothy B. Kang
*Attorney, Agent, or Firm*—Marger Johnson McCollom & Stolowitz, P.C.

[57] ABSTRACT

A concrete dowel slab joint system for maintaining adjacent sections of concrete in alignment during contraction and expansion of the concrete, and for transferring shear stresses and bending moments across a joint formed between adjacent concrete slabs. It includes a sleeve assembly for receiving and maintaining the dowel bar therewithin. In this is way, the dowel bar does not transmit substantial shear stresses to the concrete during the contraction and expansion of the concrete. The sleeve assembly comprises an elongate sleeve body having an outer surface and an inner surface, and defining a hollow interior compartment, (b) at least one closed end, and (c) at least one collapsible spacer member located within the hollow interior compartment. The collapsible spacer member engages and positions the dowel bar at a lateral distance from the inner surface of the elongate sleeve body and at a longitudinal distance from the closed end. These lateral and longitudinal distances together define an expansion area between the dowel bar and the sleeve assembly. The spacer member is collapsible by interactive forces exerted by the dowel bar moving in a lateral and/or longitudinal path within the hollow interior compartment in response to the expansion and contraction of the concrete.

18 Claims, 5 Drawing Sheets

CONCRETE SLAB DOWEL SYSTEM AND METHOD FOR MAKING SAME

BACKGROUND OF THE INVENTION

This invention relates to dowel and tying bars, and to construction joints for transferring stresses across a joint between concrete constructions.

Concrete responds to changes in temperature and moisture when movement associated with these changes (or for other reasons such as internal chemical reaction) is restrained. In these instances stresses develop that can lead to cracking. To control cracking, joints are built at interval distances short enough to maintain stresses below critical values. Transverse joints are saw cut, placed through induced cracking, or formed at pre-determined spacings.

Concrete pavements for highways, airport runways and the like are generally placed in strips or lanes with a longitudinal joint formed between adjacent strips or lanes. Concrete is poured in the first strip and allowed to cure. Subsequently, concrete is poured and cured in the adjacent strip and so on until the concrete pavement is completed. A longitudinal joint is formed between adjacent strips to facilitate construction and to reduce stresses and control cracking caused by contraction or expansion of the concrete. Transverse or slug joints are also formed in concrete by cutting or sawing the concrete at a given location and to a given depth.

Similarly, joints are formed in concrete structural slabs, walls, footings and the like to minimize stresses and/or simplify construction methods. Of these joints, there are several types. For example, the expansion joint provides a space between slabs to allow for expansion or swelling of the slab as temperature and moisture increase or growth due to any cause occurs. A construction joint provides a finished edge or end so that construction operations interrupted for some length of time may be continued or resumed without serious structural penalty.

Load is transferred across a joint principally by shear. Some bending moment may be transferred across the joints through tie joints. Good load transfer capability must be built into the joint, or the load carrying ability of the concrete slab or structure will be reduced. The alternative is to strengthen the concrete by improving support or increasing depth to minimize the joint load transfer weakness.

Tie bars and dowels are often used in concrete design to improve load transfer at the joint between concrete slabs or structures. Such tie bars and dowels are embedded in the concrete and arranged across the joint in a direction substantially perpendicular to the axis defined by the joint. Various approaches, depending on the type of tie bar or dowel, have been suggested with respect to concrete construction joints.

In the construction of concrete slabs on grade, it is common practice to install continuous side forms with dowels for future adjacent slab concrete placement and to place concrete in long continuous strips. It is also known to place slab dowels and sleeves at specified distances across the strips to allow the strips to have a controlled plane to accommodate shrinkage of the concrete. The positions of these dowel locations are marked on the side forms and the concrete after placement and finishing is struck to provide a joint at these locations, or is later sawn. This allows for a smooth controlled joint across the slab strip. However, many times the marks are destroyed and joints are placed in the wrong areas negating the advantages of the slab dowels.

The functions of the tie bars and dowels are to keep contiguous sections of concrete in alignment during contraction and expansion, and to transfer shear stresses and bending moments across the joint between the two slabs. The prior art dowels are often made smooth, lubricated, or coated entirely with plastic as disclosed in U.S. Pat. No. 3,397,626 to prevent the dowel from bonding to the concrete and allow the concrete slab or structure to slide relative to the dowel in a direction substantially perpendicular to the axis defined by the joint. Such movement of the slab relative to the dowel prevents build up of stress in the dowel that may result in cracking of the concrete.

In an alternative construction disclosed in U.S. Pat. No. 4,449,844, the dowel has its outer ends bonded to concrete and its central portion covered with plastic to prevent bonding to concrete. The dowel disclosed in Larsen performs a latent spring function to limit the movement of the concrete slab relative to the dowel when temperature changes cause the length of the slab section to vary with time.

A major disadvantage of the above prior art dowels and tie bars is that they prevent movement of the concrete slab relative to an adjacent concrete slab in a direction substantially parallel to and aligned with the axis defined by the joint. In such situations, the dowels and tie bars provide enough restraint against movement and shrinkage so that the concrete slab or structure induces stresses along a line substantially defined by ends of the dowels or tie bars. This problem is most evident in the situation when adjacent concrete slabs or strips are placed and cured in repetitive order or when adjacent concrete slabs or structures are subjected to extreme temperature differences.

For example, it is well known that concrete typically shrinks after placement. If a second concrete paving slab is placed adjacent to a first concrete paving slab that has contracted from thermal and drying shrinkage, the second concrete paving slab will likewise attempt to shrink similar to the shrinkage of the first concrete paving slab. However, dowels and tie bars arranged across the joint between the first and second concrete paving slabs will restrain the second concrete paving slab from shrinking during curing. The developed internal stress in the second concrete paving slab can create an undesirable condition that may result in cracking. Even if cracks do not develop, the internal stresses are added to the stress from the normally applied design loads and could reduce the service life of the pavement.

Another prior art slab dowel system, U.S. Pat. No. 4,578,916, relates to a connecting and pressure-distributing element for two structural members to be concreted one after the other in the same plane and separated by a joint, of the type having a socket and a bar insertable into the opening of the socket. The socket is inserted for attachment to a frontal concrete form and for embedding in the structural member to be concreted first. The bar is inserted in the socket hole and is intended for embedding in the structural member to be concreted later. The bar is at least two closed loops each of generally rectangular shape and made from reinforcing rods. The loops are secured to the socket and the bar, respectively, in one case by welding, in another case by means of a holder. Because they are symmetrically spaced from the socket and the bar, they ensure good distribution of pressure within the concrete.

An improved tying bar and joint construction for transferring stresses across a joint between concrete slabs or structures and accommodating for shrinkage and expansion of concrete is provided in U.S. Pat. No. 4,733,513. The subject bar has a resilient facing attached to at least one side of the bar so that the concrete slab or structure can move in relationship to the bar in a direction substantially perpendicular to the resilient facing. The bar is arranged across the joint in a direction substantially perpendicular to the axis defined by the joint.

In U.S. Pat. No. 5,005,331, slip and non-slip dowel placement sleeves are disclosed. The slip dowel placement sleeve generally comprises a tubular dowel receiving sheath having a closed distal end and an open proximal end. A connecting means of perpendicular flange is formed around the proximal opening of the sheath to facilitate attachment of the sheath to a concrete form. Smooth sections of dowel rod may then be advanced through holes drilled in the concrete form and into the interior compartment of the sheath. Concrete is poured within the form and the dowel rod remains slidably disposed within the interior of the sheath. Variations of the basic slip dowel placement sleeve of the invention includes a tapered "extractable" sleeve and a corrugated "grout tube" for placement of non-slip dowel or rebar.

Slip and non-slip dowel placement sleeves are disclosed in U.S. Pat. No. 5,216,862. The slip dowel placement sleeve generally comprises a tubular dowel receiving sheath having a closed distal end and open proximal end. A connecting means is formed around or inserted into the proximal opening of the sheath to facilitate attachment of the sheath to a concrete form. Smooth sections of dowel rod may then be advanced through holes drilled in the concrete form and into the interior compartment of the sheath. Concrete is poured within the form and the dowel rod remains slidably disposed with the interior of the sheath. Variations of the basic slip dowel placement sleeve of the invention include a tapered extractable sleeve and a corrugated grout tube for placement of non-slip dowel or rebar.

SUMMARY OF THE INVENTION

It has now been determined that cracking problems in reinforced concrete slabs, caused by substantial shear stresses imparted to the concrete by movement of dowel bars located therewithin during expansion and contraction of the concrete slab, can be avoided. More specifically, the cracking problem can be avoided by employing a concrete dowel slab joint system of the present invention which permits the dowel bar to undergo movement in both a lateral and longitudinal direction without imparting substantial shear stress to the concrete itself.

The subject concrete dowel slab joint system comprises a dowel bar for maintaining adjacent sections of concrete in alignment during contraction and expansion of the concrete, and for transferring shear stresses and bending moments across a joint formed between adjacent concrete slabs. It also includes a sleeve assembly for receiving and maintaining the dowel bar therewithin. In this is way, the dowel bar does not transmit substantial shear stresses to the concrete during the contraction and expansion of the concrete.

The sleeve assembly comprises an elongate sleeve body having an outer surface and an inner surface, and defining a hollow interior compartment, (b) a pair of closed ends, and (c) collapsible spacer members located within the hollow interior compartment. The collapsible spacer members engage and position the dowel bar at a lateral distance from the inner surface of the elongate sleeve body and at a longitudinal distance from the closed ends. These lateral and longitudinal distances together define an expansion area between the dowel bar and the sleeve assembly. The spacer members are collapsible by interactive forces exerted by the dowel bar moving in a lateral and/or longitudinal path within the hollow interior compartment in response to the expansion and contraction of the concrete. The sleeve assembly is also designed to prevent concrete from entering the hollow interior compartment during use in receiving and maintaining the dowel bar therewithin.

The concrete dowel slab joint system of this invention includes a hollow interior compartment which preferably has a square, round, or rectangular cross-sectional configuration. Moreover, the elongate sleeve body is typically fabricated from a polymeric material. Moreover, the collapsible spacer members are preferably fabricated from a polymeric material which is crushable by interactive forces exerted by the dowel bar as it is moved in a lateral and/or longitudinal path within the hollow interior compartment in response to the expansion and contraction of the concrete.

The spacer members can be attached to the inner surface of the closed ends thereby defining a longitudinally-extending expansion area between the dowel and the closed ends. In a preferred case, at least one of the closed ends comprise a removable end closure.

Preferably, the concrete dowel slab joint system of this invention includes at least one generally V-shaped spacer member located within the hollow interior compartment. The V-shaped spacer member includes a pair of outwardly angularly extending side sections having a pair of free ends joined together at the other end of the side sections to form a base. The base of the V-shaped spacer member is attached to an inner surface of the closed end, and the pair of free ends are joined to the inner surface of the elongate sleeve body, and one of the ends of the dowel bar engages an inner surface of the outwardly angularly extending side sections. Thus, the V-shaped spacer member configuration defines the expansion area between the dowel bar and the elongate sleeve body. In one form of this structure, the base of the generally V-shaped spacer member comprises a flat rectangular base section, and the opposed ends of the flat rectangular base section are joined to the other end of the side sections to form the generally V-shaped spacer member arrangement.

The subject concrete dowel slab joint system can also include positioning elements attached at one end to the sleeve assembly. The other end of the positioning elements will then extend upwardly to a point above the surface of the concrete. The positioning elements act as a visible locating indicator of the concrete dowel slab joint system. Preferably, the positioning elements comprise flexible elongate rod which are typically fabricated of a polymeric material.

In another preferred form of the present invention, the sleeve assembly comprises a plurality of interlocking sleeve body sections connected one to the other to form a unitary sleeve body structure. Preferably, the sleeve assembly comprises a pair of interlocking sleeve body sections each having a closed distal end and an open proximal end to which a flange is attached. The flange, which extends perpendicularly about the proximal end of each of the body sections, has formed therein a central aperture sized to permit passage of the dowel bar through the flange and into the confines of the hollow interior compartment. A clamping mechanism interlocking connects the flange of one sleeve body section to the flange of the other sleeve body section.

The foregoing and other objects, features and advantages of the invention will become more readily apparent from the following detailed description of a preferred embodiment which proceeds with reference to the drawings.

DETAILED DESCRIPTION OF PREFERRED EMBODIMENT

Conventional slab dowels are positioned within concrete sections. In a typical concrete formation sequence, the first concrete slabs and second concrete slabs are poured in sequence. Transverse joints are then saw cut or formed through methods well known in the prior art to reduce and/or relieve stresses in the concrete and prevent cracking. A longitudinal joint is formed between the two concrete strips comprising the first concrete slab and the second concrete slab.

Dowel bars are embedded in the concrete slabs for maintaining adjacent sections of concrete in alignment during contraction and expansion of the concrete, and for transferring shear stresses and bending moments across a joint formed between adjacent concrete slabs. The cross-sectional sizes and lengths of the dowel bars vary depending on the types of installation and the required forces to be counteracted. The dowel bars are placed and supported with respect to transverse joints and longitudinal joint.

Figure 1:
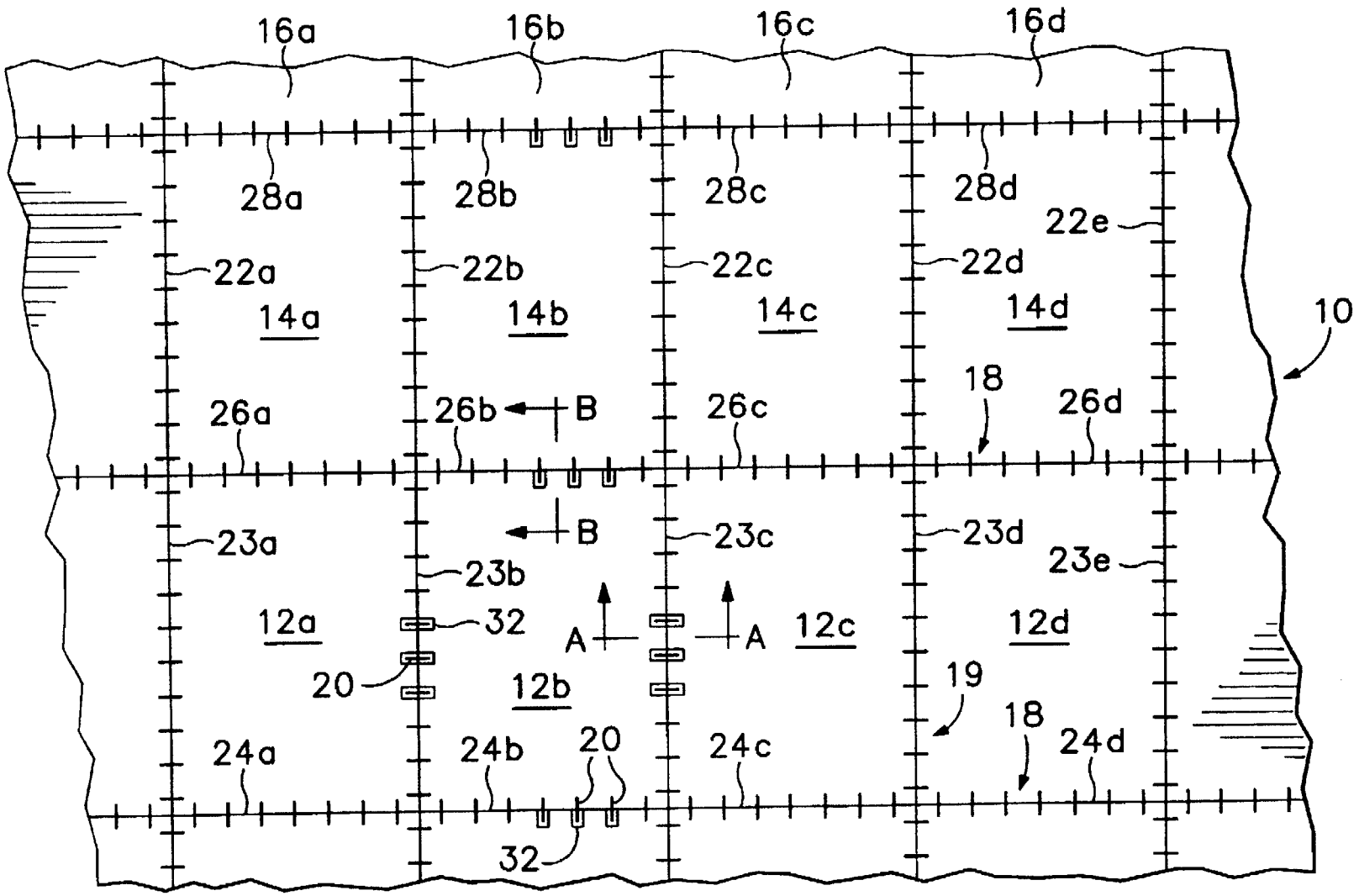
FIG. 1 is a schematic plan view of concrete slab section including dowel slab joint systems of the present invention spanning longitudinal continuous construction joints and transverse sawn or slug joints.
Figure 2:
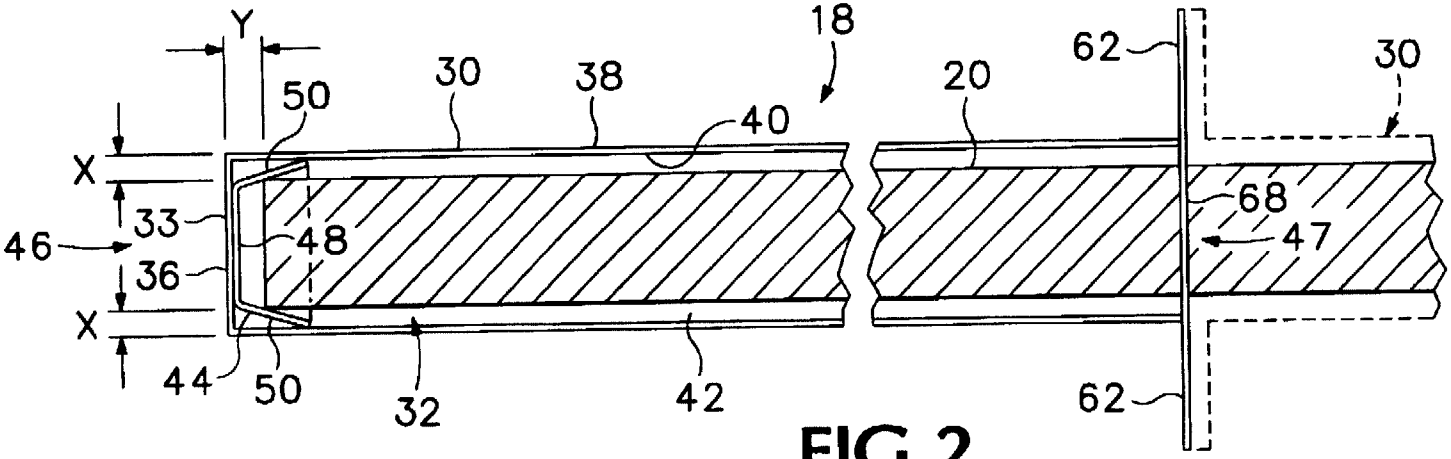
FIG. 2 is an enlarged sectional, fragmentary view of the concrete dowel slab joint system of the present invention.
Figure 3:
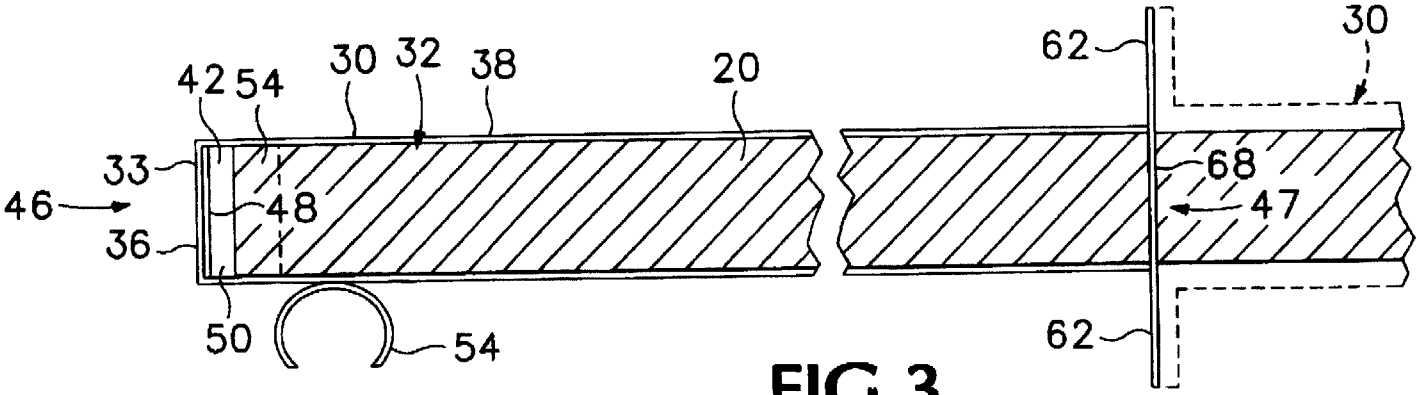
FIG. 3 is an enlarged side view of the concrete dowel joint system of FIG. 2.
Figure 4:
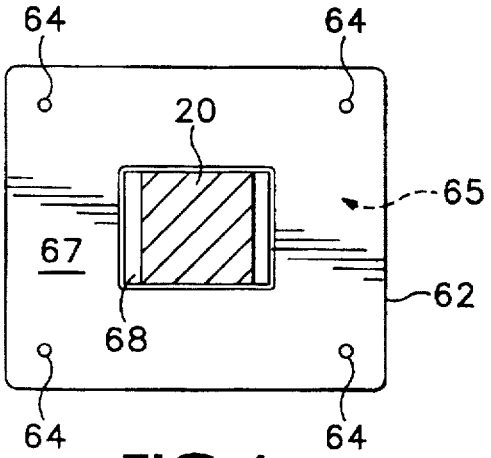
FIG. 4 is an enlarged end view looking at the open proximal end of the sleeve assembly of the concrete dowel joint system of FIG. 2.
Figure 5:
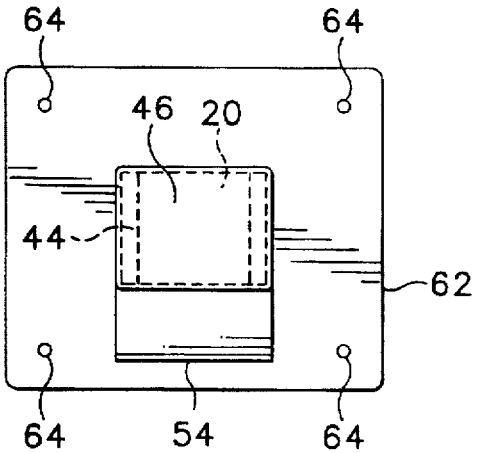
FIG. 5 is an enlarged end view looking at the closed distal end of the sleeve assembly of the concrete dowel joint system of FIG. 2.

As depicted in FIG. 1, sleeve dowel bar assemblies are embedded in the first concrete slabs, and arranged across the transverse transfer joint, 22*a* to 22*e* and, 23*a* to 23*e*, in a direction substantially perpendicular to the axes defined by the transverse transfer joint. Similarly, dowel sleeves are embedded in the first concrete slabs and arranged across the joint in a direction substantially perpendicular to the axes defined by the longitudinal transfer joint 24*a* to 28*a*, etc. In a typical installation sleeve, dowel bars assembly 32 are positioned on the rebar-matrix, and the concrete slab is poured. The concrete slab is allowed to harden in situ with the sleeve dowel bars assembly and dowel sleeves embedded therein.

After the first concrete slab has undergone expansion or contraction from thermal or drying shrinkage, the second concrete slab is placed adjacent to the first concrete slab after the dowel bars are inserted into the sleeves previously placed in the prior concrete pour so that the dowel bars are also essentially embedded in the second concrete slabs. The second concrete slab will attempt to shrink during curing in a similar manner to the shrinkage of the first concrete slab.

In a conventional installation, the dowel bars arranged across longitudinal joints between the first and second concrete slabs will attempt to restrain the second concrete slabs from movement. The developed and internal stress in the second concrete slab can create an added stress which may cause cracking by itself or when added to an applied load upon the slabs. The cracks will often develop along a line near the ends of the dowels bars. Referring now to FIG. 1, an illustrative reinforced concrete slab section 10 is shown which includes two versions of the concrete dowel slab joint system of the present invention in place of convention dowel bars previously discussed. In a first version, denoted 18, a dowel bar 20 is positioned within a single sleeve body 30. This first version is used to bridge longitudinal joints, for example, the joints formed between adjacent slab segments 12*a*, 14*a*, 16*a*, etc. In a second version, denoted 19, a dowel bar is positioned within the confines of a pair of sleeve body 30. The second version is employed to bridge transverse joints 22*a*, 22*b*, 22*c* etc.

A reinforced concrete slab section 10 comprises a concrete slab and may include an interconnected matrix of reinforcing re-bar rods (not shown). The matrix of reinforcing re-bar rods are arranged in a predetermined pattern according to known principals of structural engineering.

Figure 6:
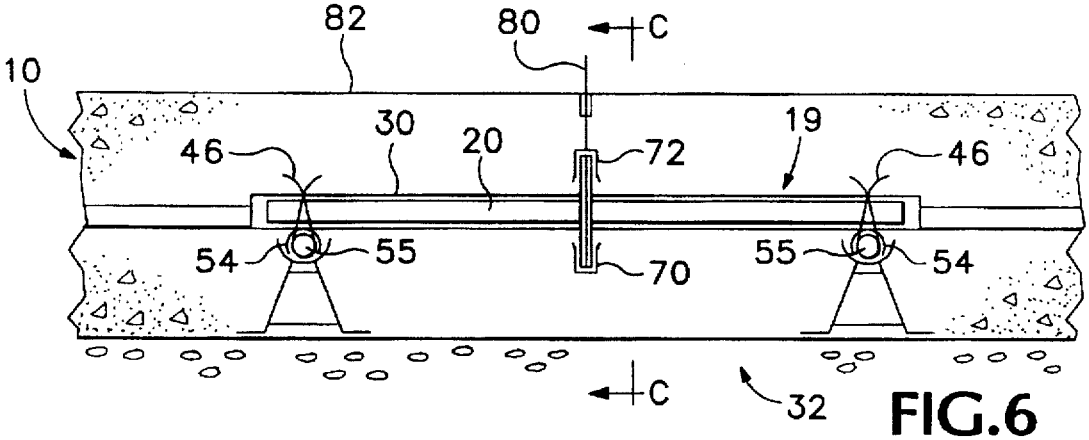
FIG. 6 is a sectional view taken along line A—A of FIG. 1.
Figure 7:
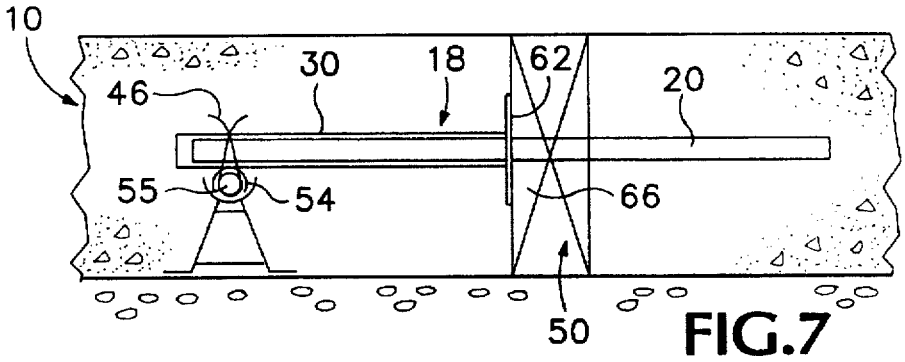
FIG. 7 is a sectional view taken along line B—B of FIG. 2.

As shown more specifically in FIGS. 6 and 7, the reinforcing re-bar rods 55 are held in position by wire ties 46. The rods 55 are maintained at a predetermined relative height by re-bar rod supports 54. The slab reinforcing re-bar rods 55 are held in position atop the re-bar supports 54 by wire ties 46. Saw cut or slug joints 22*a*–22*e* and 23*a* –23*e*, respectfully, in the concrete slab and partitions it into respective rectangular segments 12*a*–12*d*, 14*a*–14*d* and 16*a*–16*d*, respectfully. The concrete dowel slab joint systems 19 of the present invention can be embedded in the concrete slab section 10, and can be arranged in position across a transverse joint in a direction substantially perpendicular to an axis defined by the joint. As previously described, in a typical installation, each concrete dowel slab joint system 19 is centrally positioned, and the concrete slab is poured and hardens in situ with the concrete dowel slab joint system embedded therein.

When the prior art dowel bars are replaced by the concrete dowel slab joint systems 18 and 19 they are held in firm position and resists displacement of one concrete slab relative to the other as in the case of conventional dowel bars. The concrete dowel slab joint systems 18 and 19, unlike its prior art counterparts, allows the slabs to move laterally and longitudinally with respect to each other without inducing substantial stresses within the slabs or on the dowel bar, respectively.

Figure 8:
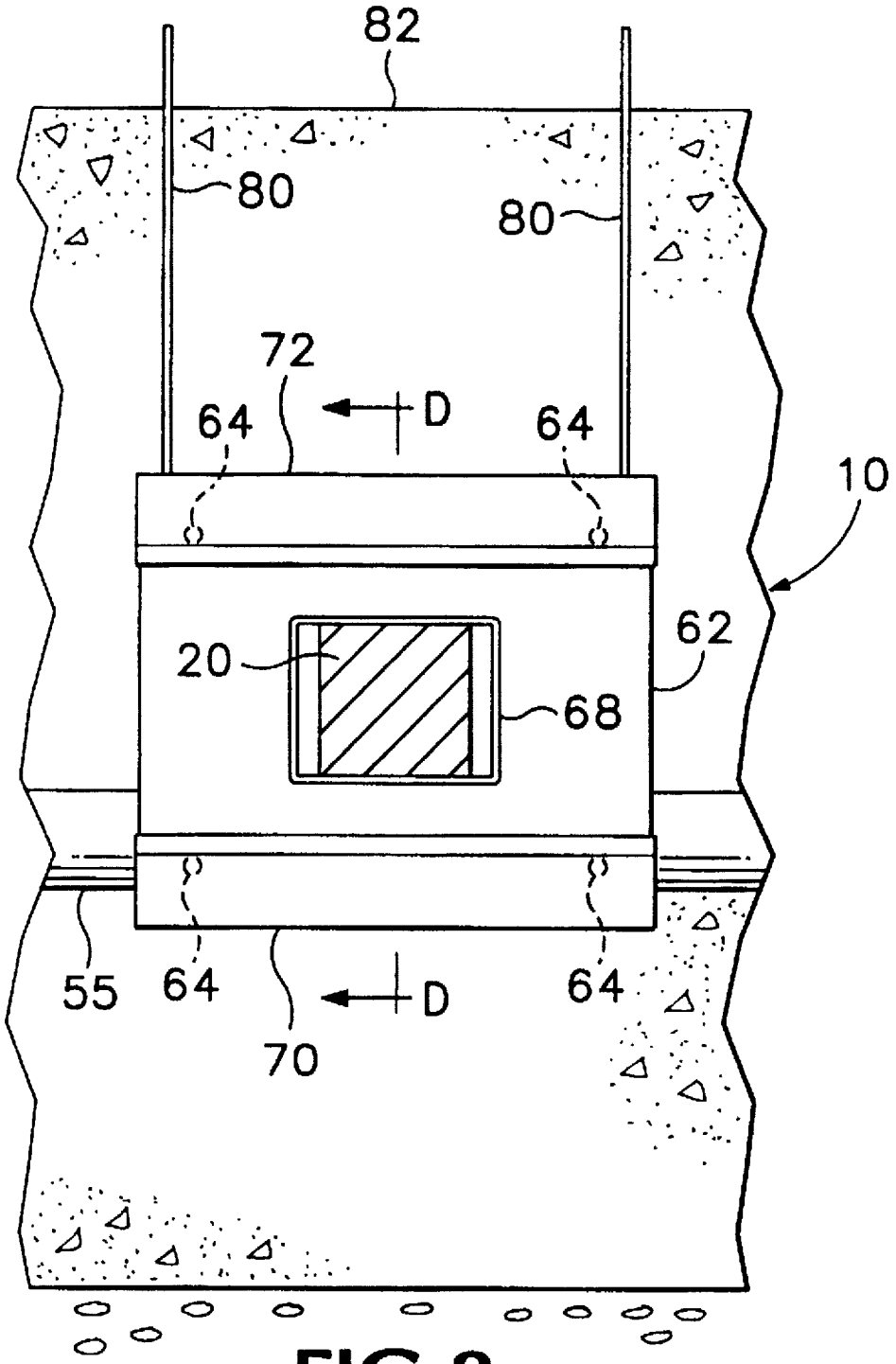
FIG. 8 is a sectional view taken along line C—C of FIG. 6.
Figure 9:
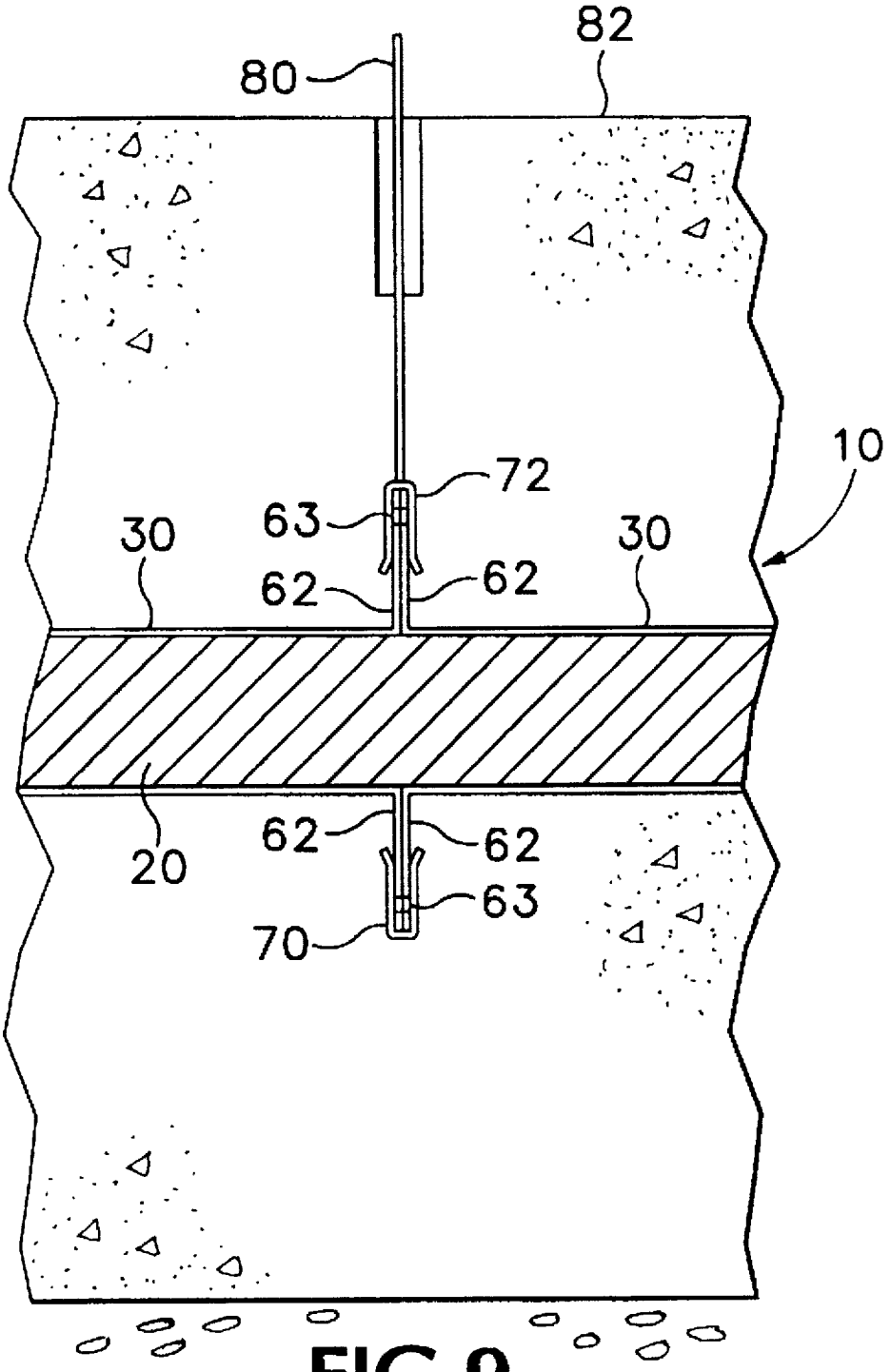
FIG. 9 is a sectional view taken along line D—D of FIG. 8.

Referring now to FIGS. 2–5, the concrete dowel slab joint systems 18 and 19 of this invention are depicted, FIGS. 2–5 and 7 showing systems 18 and FIGS. 6, 8 & 9 showing system 19. More specifically, the systems 18 & 19 retain dowel bar 20, which is typically a conventional elongate steel dowel bar having a square rectangular round or oval cross-sectional area, and maintains bar 20 in position within sleeve assembly section 32. Sleeve assembly 32 receives and maintains dowel bar 20 within its confines without inducing shear stresses within concrete slab 10. More specifically, sleeve assembly section 32 comprises an elongate sleeve body 30 having a closed end 36, an outer surface 38 and an inner surface 40. The elongate sleeve body 30 defines a hollow interior compartment 42. It should be noted that the closed end 36 can comprise either a rectangular end piece 33 (see FIG. 2) sized to fit flush with the rectangular opening at the ends of the elongate sleeve body, or a rectangular shaped cap (not shown) which tightly nests about the respective ends of elongate sleeve body.

At the end of the hollow inner compartment 42, and attached to the inner surface of the closed end section 36 and elongate sleeve body 30, respectively, are located collapsible spacer member 44. As more specifically shown in FIG. 2, a collapsible spacer member 44 maintain dowel bar 20 in an initial position at predetermined lateral distance "X" from the inner surface 40 of the elongate sleeve body 30. Collapsible spacer member 44 also maintain dowel bar 20 at a longitudinal distance "Y" from the closed ends 36 the respective lateral and longitudinal distances, X and Y, between the dowel bar 20 and the inner surfaces 40 of the elongate sleeve body 30 and closed end 36 define there between and expansion area for movement of the dowel bar 30 during expansion and contraction of the reinforced concrete slab section 10.

Collapsible spacer members 44 are generally in the form of V-shaped inserts which comprise a flat base section 48 and a pair of outwardly angularly extending side sections 50, one end of the side sections 50 being joined to the ends of the flat base section 48 and the other end of the side sections 50 being a free end. The flat base section 48 is joined to the inner surface of the closed end 36, and the free end of the outwardly angularly extending side sections 50 are attached to the inner surface 40 of the elongate sleeve body 30.

Concrete dowel slab joint system 19 is comprised of a pair of substantially identical sleeve assembly sections 32 which are connected one to the other. Moreover, section 32 of slab joint dowel system 19 are disconnected one from the other for purposes of inserting dowel bar 20 into hollow inner compartment 42.

As shown, more specifically in FIGS. 6, 8, and 9, the respective section 32 of systems 18 and 19 are connected engaged one to the other by a clamping assemblies 70 & 72. The section 32 of system 19 each having a closed distal end 45 and an open proximal end 47, a flange 62 being attached to and extending perpendicularly about the proximal end 47 of each of the body section 30. Flanges 62 each have formed therein a central aperture 68 sized to permit passage of dowel bar 20 through flange 62 and into the confines of the hollow interior compartment 42. Clamping assembly 70 located adjacent to the top and bottom surfaces of flange 62. Flange 62 includes a central rectangular slot 68 having a complementary inner rectangular dimension as the cross sectional dimension of elongate sleeve body 30. The inner edges of rectangular slot 68 are joined to the open end 47 of sleeve assembly 32.

To form concrete dowel slab joint system 19, dowel bar 20 is introduced into the hollow interior compartment 42 of either one of the sections 32. Sections 32 are then interlockingly joined together by engaging the outer surfaces of flanges 62 of each section 32, and interlockingly engaging clamp caps 70 about the top and bottom ends of engaged flanges 62, clamps caps 70 interlockingly extending about flanges 62. Flanges 62 include pin 63 which pass through aperture 69 in flange 62 to connect clamp caps 70 to flanges 62. The upper clamp cap 72 can comprise upwardly extending flexible positioning elements 80. The elongate U-shaped clamp caps 70 & 72 are sized to extend over the top and bottom edges of flanges 62 and to be interlockingly connected to flanges 62 by pins 63 so that sections 32 are held together in interlocking engagement during the entire procedure for producing concrete slab section 10. Thus, dowel bar 20 is positioned with section 30 so that it engages the collapsible spacer members 44, without collapsing same. In this way, dowel bar 20 is maintained at a lateral distance "X" from the inner surface of the elongate sleeve body 30, and at a longitudinal distance "Y" from the closed ends 36 thereby defining an expansion area between the dowel bar 20 and the sleeve assembly 32. Furthermore, the sleeve assembly 32 is maintained so that it prevents concrete from entering the hollow interior compartment 42 during use in receiving and maintaining the dowel bar 20 therewithin.

When concrete slab section 10 is formed positioning elements 80, in the form of flexible rods, will extend upwardly out from the upper surface of concrete slab 32 thereby indicating the position within the concrete section 10 of slab joint dowels system 19. Re-bar support members 54 are optionally attached to the outer bottom surface of elongate sleeve body 32 for saw cut or slug joint construction. Re-bar support members 54 have a complementary shape to slab reinforcing re-bar rods 55, and are designed to maintain slab joint dowel system 32 in place atop the slab reinforcing re-bar rods 55. Moreover, slab joint dowel system 19 is further maintained in position atop slab reinforcing re-bar rods 55 through the use of wire ties 46.

Referring now to FIG. 7, dowel slab joint systems 18 are assembled by first mounting support clamps 54 of body section 30 onto rebar 55. An edge form 50 is constructed. Then the flanges 62 are attached to the edge form 50 by inserting fasteners 66 through apertures 69 and into edge form 50. Alternatively, flange 62 can have a self-adhering adhesive surface 65, with pull off protection cover 67 which adheres. A first concrete slab is then poured over the previously mounted body section 32 within the confines of the edge form 50. After the concrete slab is cured, the form is removed exposing central slots 68 of body sections 32. Dowel bars 20 are inserted into open slots 68 and a second concrete slab is poured adjacent to the first cured concrete slab, a longitudinal construction joint being located between the adjacent first and second concrete slabs.

In use, the dowel bar 20 remains in position engaging the collapsible space members 44 until substantial expansion and contraction of the concrete slabs take place. Then, the dowel bar 20 will be moved in response to the expansion and contraction of the concrete slab section 10 thereby collapsing the spacer members 44 which moves the dowel bar 20 in a lateral and/or longitudinal path within the hollow interior compartment 42. Thus, when interactive forces are exerted on a dowel bar 20 located within the aforementioned expansion area, the dowel bar does not transmit substantial shear stresses to the concrete or tie dowel during contraction and expansion of the concrete.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

We claim:

1. A concrete dowel slab joint system, comprising:

a dowel bar for maintaining adjacent sections of concrete in alignment during contraction and expansion of the concrete, and for transferring shear stresses and bending moments across a joint formed between adjacent concrete slabs; and a sleeve assembly for receiving and maintaining the dowel bar therewithin so that the dowel bar does not transmit substantial shear stresses to the concrete during the contraction and expansion of the concrete, the sleeve assembly comprising (a) an elongate sleeve body having an outer surface and an inner surface, and defining a hollow interior compartment (b) at least one closed end, and;

(c) at least one generally v-shaped collapsible spacer member located within the hollow interior compartment, said V-shaped spacer member including a pair of outwardly angularly extending side sections having a pair of free ends and joined together at the other end of the side sections to form a base, the base of the V-shaped spacer member being attached to an inner surface of the closed end, and the pair of free ends being joined to the inner surface of the elongate sleeve body, one of the ends of the dowel bar engaging an inner surface of the outwardly angularly extending side sections thereby defining the expansion area between the dowel bar and the elongate sleeve body each collapsible spacer member engaging and positioning the dowel bar at a lateral distance from the inner surface of the elongate sleeve body and at a longitudinal distance from the closed end, said lateral distance and said longitudinal distance together defining an expansion area between the dowel bar and the sleeve assembly, each spacer member being collapsible by interactive forces exerted by the dowel bar moving in a lateral and/or longitudinal path within the hollow interior compartment in response to the expansion and contraction of the concrete.

2. The concrete dowel slab joint system of claim 1, wherein the hollow interior compartment has a rectangular cross-sectional configuration.

3. The concrete dowel slab joint system of claim 1, wherein the elongate sleeve body is fabricated from a polymeric material.

4. The concrete dowel slab joint system of claim 1, wherein the collapsible spacer member is fabricated from a polymeric material which is crushable by the interactive forces exerted by the dowel as it is moved in a lateral and/or longitudinal path within the hollow interior compartment in response to the expansion and contraction of the concrete.

5. The concrete dowel slab joint system of claim 1, wherein the spacer member is attached to the inner surface of the closed end thereby defining a longitudinally-extending expansion area between the dowel bar and the closed end.

6. The concrete dowel slab joint system of claim 1, wherein the base of the generally V-shaped spacer member comprises a flat rectangular base section, opposed ends of the flat rectangular base section being joined to the other end of the side sections to form the V-shaped spacer member.

7. The concrete dowel slab joint system of claim 1, which further includes positioning elements attached at one end to the sleeve assembly, the other end of the positioning elements extending upwardly to a point above the surface of the concrete and acting as a visible locating indicator of the concrete dowel slab joint.

8. The concrete dowel slab joint system of claim 1, wherein said sleeve assembly comprises a plurality of interlocking sleeve body sections connected one to the other to form a unitary sleeve body structure.

9. A sleeve assembly which receives and maintains a dowel bar for maintaining adjacent sections of concrete in alignment during contraction and expansion of the concrete, and for transferring shear stresses and bending moments across a joint formed between adjacent concrete slabs, which comprises:

(a) an elongate sleeve body having an outer surface and an inner surface, and defining a hollow interior compartment, (b) at least one closed end, and (c) at least one generally v-shaped collapsible spacer member located within the hollow interior compartment, said V-shaded spacer member including a pair of outwardly angularly extending side sections having a pair of free ends and joined together at the other end of the side sections to form a base, the base of the V-shaped spacer member being attached to an inner surface of the closed end, and the pair of free ends being joined to the inner surface of the elongate sleeve body, one of the ends of the dowel bar engaging an inner surface of the outwardly angularly extending side sections thereby defining the expansion area between the dowel bar and the elongate sleeve body each collapsible spacer member engaging and positioning the dowel bar at a lateral distance from the inner surface of the elongate sleeve body and at a longitudinal distance from the closed end, said lateral distance and said longitudinal distance together defining an expansion area between the dowel bar and the sleeve assembly, the spacer member being collapsible by interactive forces exerted by the dowel bar moving in a lateral and/or longitudinal path within the hollow interior compartment in response to the expansion and contraction of the concrete.

10. A concrete dowel slab joint system, comprising:

a dowel bar for maintaining adjacent sections of concrete in alignment during contraction and expansion of the concrete, and for transferring shear stresses and bending moments across a joint formed between adjacent concrete slabs; and a sleeve assembly comprising a plurality of interlocking sleeve body sections connected one to the other to form a unitary sleeve body structure for receiving and maintaining the dowel bar therewithin so that the dowel bar does not transmit substantial shear stresses to the concrete during the contraction and expansion of the concrete, the sleeve assembly comprising (a) an elongate sleeve body having an outer surface and an inner surface, and defining a hollow interior compartment, (b) at least one closed end, and (c) at least one collapsible spacer member located within the hollow interior compartment, the collapsible spacer members engaging and positioning the dowel bar at a lateral distance from the inner surface of the elongate sleeve body and at a longitudinal distance from the closed end, said lateral distance and said longitudinal distance together defining an expansion area between the dowel bar and the sleeve assembly, the spacer member being collapsible by interactive forces exerted by the dowel bar moving in a lateral and/or longitudinal path within the hollow interior compartment in response to the expansion and contraction of the concrete.

11. The concrete dowel slab joint system of claim 10, wherein said sleeve assembly further comprises a pair of connectable sleeve body sections each having a closed distal end and an open proximal end, a flange attached to and extending perpendicularly about the proximal end of each of the body sections, each said flange having formed therein a central aperture sized to permit passage of said dowel bar through said flange and into the confines of the hollow interior compartment, and a clamping mechanism for connecting the flange of one sleeve body section to the flange of the other sleeve body section.

12. A method for maintaining adjacent sections of concrete in alignment using a dowel bar during contraction and expansion of the concrete and for transferring shear stresses and bending moments across a joint formed between adjacent concrete slabs, which comprises:

providing a sleeve assembly for receiving and maintaining the dowel bar therewithin so that the dowel bar does not transmit substantial shear stresses to the concrete during the contraction and expansion of the concrete, the sleeve assembly comprising (a) an elongate sleeve body having an outer surface and an inner surface, and defining a hollow interior compartment, (b) at least one closed end, and (c) generally v-shaped collapsible spacer members located within the hollow interior compartment said V-shaped spacer member including a pair of outwardly angularly extending side sections having a pair of free ends and joined together at the other end of the side sections to form a base, the base of the V-shaped spacer member being attached to an inner surface of the closed end, and the pair of free ends being joined to the inner surface of the elongate sleeve body, one of the ends of the dowel bar engaging an inner surface of the outwardly angularly extending side sections thereby defining the expansion area between the dowel bar and the elongate sleeve body;

introducing the dowel bar into the hollow interior compartment;

positioning the dowel bar so that it engages the collapsible spacer members, without collapsing same, at a lateral distance from the inner surface of the elongate sleeve body and at a longitudinal distance from the closed end, said lateral distance and said longitudinal distance together defining an expansion area between the dowel bar and the sleeve assembly; and collapsing the spacer members by moving the dowel bar in a lateral and/or longitudinal path within the hollow interior compartment in response to the expansion and contraction of the concrete by exerting interactive forces on said dowel bar thereby preventing the dowel bar from transmitting substantial shear stresses to the concrete during contraction and expansion of the concrete.

13. The method of claim 12, which includes the step of attaching the spacer member to the inner surface of the closed end thereby defining a longitudinally-extending expansion area between the dowel bar and the closed end.

14. The method of claim 12, which includes the step of providing at least one generally V-shaped spacer member comprising a flat rectangular base section, and joining the opposed ends of the flat rectangular base section to the other end of the side sections to form the V-shaped spacer member.

15. The method of claim 12, which further includes the step of providing at least one flexible elongate rod, attaching one end of each flexible elongate rod to each sleeve assembly, the other end of the flexible elongate rod extending upwardly to a point above the surface of the concrete and acting as a visible locating indicator of the concrete dowel slab joint.

16. The method of claim 12, which includes the step of providing a sleeve assembly comprising a plurality of connectable sleeve body sections, each sleeve body section having a closed end and a collapsible spacer member located within the hollow interior compartment, and connecting said sleeve body sections one to the other to form a unitary sleeve body structure.

17. The method of claim 16, which further includes the step of providing sleeve body sections comprising a closed distal end and an open proximal end, a flange attached to and extending perpendicularly about the proximal end of each of the sleeve body sections, said flange having formed therein a central aperture sized to permit passage of said dowel bar through said flange and into the confines of the hollow interior compartment, and connecting the flange of one sleeve body section to the flange of the other sleeve body section to form a unitary sleeve assembly structure.

18. The method of claim 17, which further includes the step of connecting said sleeve body sections one to the other to form a unitary sleeve assembly structure by clamping the flange of one sleeve body section to the flange of the other sleeve body section.

* * * * *

UNITED STATES PATENT AND TRADEMARK OFFICE

CERTIFICATE OF CORRECTION

PATENT NO. : 5,713,174
DATED : February 3, 1998
INVENTOR(S) : Donald R. Kramer

It is certified that error appears in the above-identified patent and that said Letters Patent is hereby corrected as shown below:

Title page,
Item [21], Appl. No. "587,229" should read -- 08/587,229 --

Column 6,
Line 13, "bar is" should read -- bar 20 is --
Lines 27 and 29, "respectfully" should read -- respectively --

Column 10,
Line 1, "V-shaded" should read -- V-shaped --

Signed and Sealed this

First Day of April, 2003

JAMES E. ROGAN
*Director of the United States Patent and Trademark Office*